US010448703B2

(12) United States Patent
Schiller et al.

(10) Patent No.: US 10,448,703 B2
(45) Date of Patent: Oct. 22, 2019

(54) FOOTWEAR SOLE STRUCTURE WITH COMPLIANT MEMBRANE

(71) Applicant: NIKE, Inc., Beaverton, OR (US)

(72) Inventors: Denis Schiller, Vancouver, WA (US); Jeremy D. Walker, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 177 days.

(21) Appl. No.: 15/564,603

(22) PCT Filed: Apr. 4, 2016

(86) PCT No.: PCT/US2016/025856
§ 371 (c)(1),
(2) Date: Oct. 5, 2017

(87) PCT Pub. No.: WO2016/164302
PCT Pub. Date: Oct. 13, 2016

(65) Prior Publication Data

US 2018/0070674 A1 Mar. 15, 2018

Related U.S. Application Data

(60) Provisional application No. 62/144,396, filed on Apr. 8, 2015.

(51) Int. Cl.
*A43C 15/00* (2006.01)
*A43B 13/18* (2006.01)
(Continued)

(52) U.S. Cl.
CPC ..... *A43B 13/183* (2013.01); *A43B 5/02* (2013.01); *A43B 5/185* (2013.01); *A43B 13/14* (2013.01);
(Continued)

(58) Field of Classification Search
CPC .. A43B 5/00; A43B 5/001; A43B 5/02; A43B 13/183; A43B 13/184;
(Continued)

(56) References Cited

U.S. PATENT DOCUMENTS 3,043,026 A * 7/1962 Semon ..... A43C 13/04 36/134
4,146,979 A * 4/1979 Fabbrie ..... A43C 15/167 36/127
(Continued)

FOREIGN PATENT DOCUMENTS

EP 1264555 A1 12/2002
GB 2322534 A 9/1998
(Continued)

OTHER PUBLICATIONS

International Searching Authority, International Search Report and Written Opinion of Application No. PCT/US2016/025856, dated Jun. 23, 2016.
(Continued)

*Primary Examiner* — Marie D Bays
(74) *Attorney, Agent, or Firm* — Honigman LLP; Matthew H. Szalach; Jonathan P. O'Brien

(57) ABSTRACT

A sole structure for an article of footwear includes an outsole and a membrane layer. The outsole has a plurality of protrusions that extend from a base layer. The membrane layer extends between the plurality of protrusions and includes at least a portion that is separated from the base layer by a distance. The membrane layer forms an outer surface of the article of footwear, and is configured to elastically deform toward the base layer in response to an applied force.

18 Claims, 3 Drawing Sheets

(51) Int. Cl.

| | |
|---|---|
| ***A43C 15/02*** | (2006.01) |
| ***A43B 5/02*** | (2006.01) |
| ***A43B 5/18*** | (2006.01) |
| ***A43B 13/14*** | (2006.01) |
| ***A43B 13/26*** | (2006.01) |
| ***A43C 15/16*** | (2006.01) |

(52) U.S. Cl.
CPC ..... *A43B 13/26* (2013.01); *A43C 15/00* (2013.01); *A43C 15/02* (2013.01); *A43C 15/161* (2013.01)

(58) Field of Classification Search
CPC ..... A43B 13/181; A43B 13/20; A43C 19/00; A43C 15/00; A43C 15/02; A43C 13/00
USPC ..... 36/59 R, 61, 134
See application file for complete search history.

(56) References Cited

U.S. PATENT DOCUMENTS

| | | | | |
|---|---|---|---|---|
| 4,271,608 | A * | 6/1981 | Tomuro | A43C 15/165 36/127 |
| 6,698,110 | B1 * | 3/2004 | Robbins | A43B 5/185 36/134 |
| 7,814,687 | B2 * | 10/2010 | Cook | A43B 1/0036 36/137 |
| 10,034,515 | B2 * | 7/2018 | Rushbrook | A43B 5/02 |
| 2002/0178620 | A1 * | 12/2002 | Asciolla | A43B 13/36 36/132 |
| 2004/0111922 | A1 * | 6/2004 | Fusco | A43B 13/12 36/59 R |
| 2009/0293315 | A1 | 12/2009 | Auger et al. | |
| 2016/0058107 | A1 * | 3/2016 | Walker | A43B 13/04 36/98 |
| 2016/0286905 | A1 * | 10/2016 | Schiller | A43B 3/166 |

FOREIGN PATENT DOCUMENTS

| | | | |
|---|---|---|---|
| WO | WO-0213643 | A1 | 2/2002 |
| WO | WO-2010036988 | A2 | 4/2010 |

OTHER PUBLICATIONS

International Preliminary Examining Authority, Written Opinion for Application No. PCT/US2016/025856, dated Mar. 1, 2017.

* cited by examiner

FOOTWEAR SOLE STRUCTURE WITH COMPLIANT MEMBRANE

CROSS REFERENCE TO RELATED APPLICATIONS

This application claims the benefit of priority from PCT Application No. PCT/US2016/025856, filed 4 Apr. 2016, which claims the benefit of priority from U.S. Provisional Application No. 62/144,396, filed 8 Apr. 2015, the disclosures of which are hereby incorporated by reference in their entirety.

TECHNICAL FIELD

The present invention relates generally to the outsole of an article of footwear.

BACKGROUND

It is advantageous, when participating in various activities, to have footwear that provides traction and stability on the surface upon which the activities take place. Accordingly, sole structures for articles of footwear have been developed with traction systems that include ground engaging protrusions to provide traction on a variety of surfaces. Examples include cleated shoes developed for outdoor sports, such as soccer, football, and baseball.

During use, compressed ground material may have a tendency to adhere to the sole structure between the respective protrusions, which may decrease their effectiveness in providing traction.

DETAILED DESCRIPTION

Figure 1:
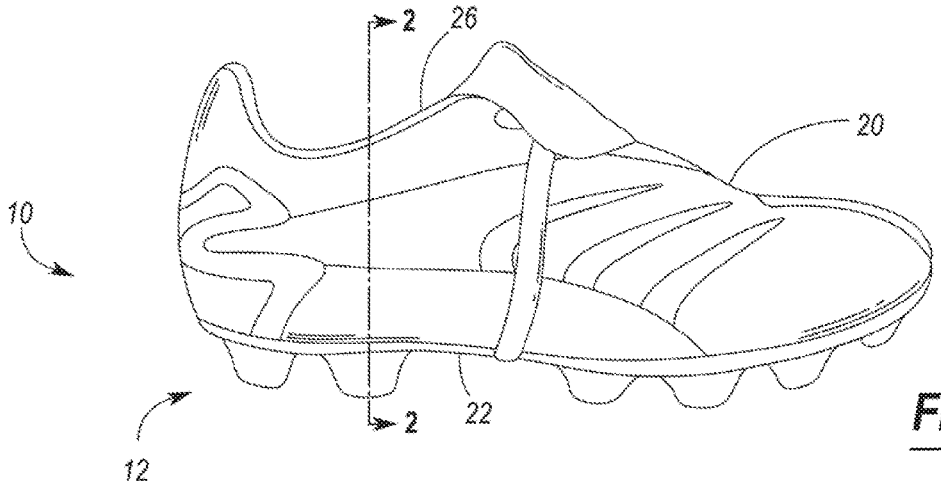
FIG. 1 is a schematic side view of an article of footwear.

A sole structure for an article of footwear includes an outsole and a membrane layer. The outsole has a plurality of protrusions that extend from a base layer. The membrane layer extends between the plurality of protrusions and includes at least a portion that is separated from the base layer by a distance. The membrane layer forms an outer surface of the article of footwear, and is configured to elastically deform toward the base layer in response to an applied force.

In one configuration the membrane layer has a thickness of from about 0.1 mm to about 4.0 mm, and is formed from a polymer having a 300% modulus of from about 10 kg/cm2 to about 110 kg/cm2. The polymer may include, for example, at least one of a rubber or a thermoplastic polyurethane, and may have a hardness of from about 30 A to about 80 A, measured on the Shore A scale. In one configuration, the membrane layer is hydrophobic such that the static contact angle of liquid water on the surface of the membrane is greater than about 130°. In another configuration, the membrane layer is hydrophilic such that the static contact angle of liquid water on the surface of the membrane is less than about 95°.

In one configuration, the membrane layer may be secured to each of the plurality of protrusions, and in some embodiments, may be secured to the base layer. When assembled, the membrane layer and the outsole at least partially define a volume. The volume may be a closed volume, and, in one configuration, may be filled with a gas. In one configuration, the membrane layer may be at least partially transparent such that the base layer is at least partially visible through the membrane layer.

During normal use, the membrane layer is configured to transition from a deformed state toward a neutral state when the applied force is removed. Such a transition may be operative to eject debris from between the plurality of protrusions.

In one configuration, each of the plurality of protrusions may include an anchor configured to receive a traction element. As such, the sole structure may further include a plurality of traction elements, with each traction element disposed in the anchor of a respective one of the plurality of protrusions. The membrane layer may then be mechanically secured between each of the plurality of protrusions and each of the respective traction elements.

Similarly, a method of manufacturing a sole structure for an article of footwear may include providing an outsole including a plurality of protrusions extending from a base layer, and affixing a membrane layer to the outsole. The membrane layer may be affixed such that it extends between the plurality of protrusions and includes at least a portion that is separated from the base layer by a distance and forms an outer surface of the article of footwear.

The method may further include forming the membrane layer from a polymer having a 300% modulus of from about 10 kg/cm2 to about 110 kg/cm2, and having a thickness of from about 0.1 mm to about 4.0 mm.

In one configuration, affixing the membrane layer to the outsole includes at least partially forming a closed volume between the membrane layer and the base layer. Likewise, affixing the membrane layer to the outsole may include securing the membrane layer to each of the plurality of protrusions and/or to the base layer Finally, the method may further include securing a traction element to a protrusion of the plurality of protrusions, such that the step of affixing the membrane layer to the base layer includes mechanically securing the membrane layer between the traction element and the protrusion.

Referring to the drawings, wherein like reference numerals are used to identify like or identical components in the various views, FIG. 1 schematically illustrates an article of footwear 10 that is intended to be secured to the foot of a wearer, for example, during an athletic competition. The article of footwear 10 includes a heel portion 12 and a toe portion that are disposed on opposing ends of the footwear 10 and that correspond to respective portions of the wearer's foot. During normal use, the article of footwear 10 is secured to the foot of the wearer to provide a comfortable, secure covering for the foot, while also providing increased traction between the foot and the ground.

Figure 2:
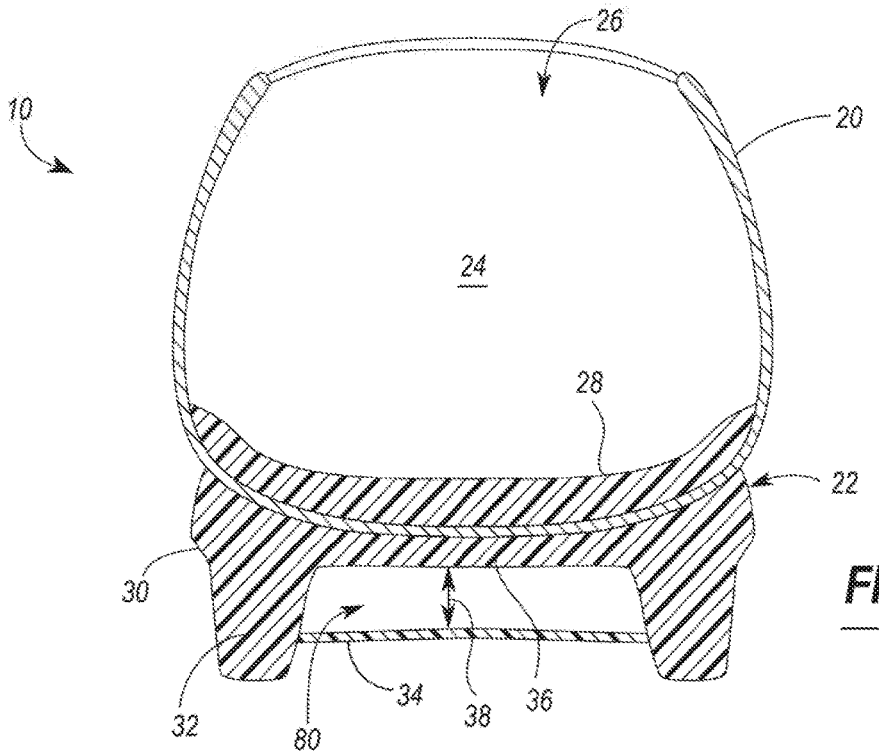
FIG. 2 is a schematic cross-sectional view of the article of footwear of FIG. 1, taken along line 2-2.

The article of footwear 10 generally includes an upper portion 20 (i.e., an "upper 20") that is coupled with a sole structure 22. As best illustrated in FIG. 2, the upper 20 defines an internal volume 24 that is configured to receive the wearer's foot and an ankle opening 26 through which the wearer's ankle may extend. When the foot is located within the internal volume 24, the upper 20 may extend along a lateral side of the foot, along a medial side of the foot, over the foot, around the heel, and under the foot. The ankle opening 26 is generally located toward the heel portion 12, and provides the foot with access to the internal volume 24. The upper 20 may include a sock liner 28 positioned within the volume 24 opposite the ankle opening 26 such that the sock liner 28 contacts the underside of the foot to enhance the comfort of footwear 10.

The sole structure 22 is secured to a lower portion of the upper 20 such that it abuts the underside of the wearer's foot during use. The sole structure 22 is operative to, for example, attenuate ground reaction forces (i.e., cushion the foot), provide traction with the ground, enhance stability, and influence the motions of the foot.

In general, the sole structure 22 includes an outsole 30 that forms an outer, lower surface of the footwear 10, where the outsole 30 is configured to contact the ground during normal use. In some embodiments, various cushioning elements may be disposed between the outsole 30 and the upper 20, and may constitute a "midsole" layer (not shown). The cushioning elements may include one or more foams, gels, liquids, or gasses that may be operative to dampen or reduce impact forces when the outsole 30 contacts the ground.

In one configuration, such as shown in FIGS. 1-2, the article of footwear 10 may include a plurality of protrusions 32, or "cleats," that are intended to increase traction on a deformable ground surface media by penetrating into the media. Such an article of footwear 10 may be used in athletic competitions that are played on grass or soil. As shown in FIG. 1, in one configuration, a first plurality of protrusions 32 may be located proximate the toe portion 12, while a second plurality of protrusions 32 may be located proximate the heel portion 12. In other configurations, protrusions 32 may be distributed across the entire sole structure.

During use, grass and/or soil (i.e., "debris" or "ground material") may have a tendency to compact between the cleats and adhere to the outsole 30. In doing so, the compacted/adhered ground material may effectively decrease the length of the protrusions 32 by reducing the amount that the protrusions may penetrate into the ground. To reduce the likelihood that the ground material may adhere to the outsole, the outsole 30 may include an elastic membrane layer 34 that is configured to urge the ground material away from the outsole 30. The membrane layer 34 may be separated from a base layer 36 of the outsole 30 by a distance 38, and may extend between at least two of the plurality of protrusions 32. As generally illustrated in FIG. 2, the membrane layer 34 may thus form an outer surface of the article of footwear 10.

Figure 3:
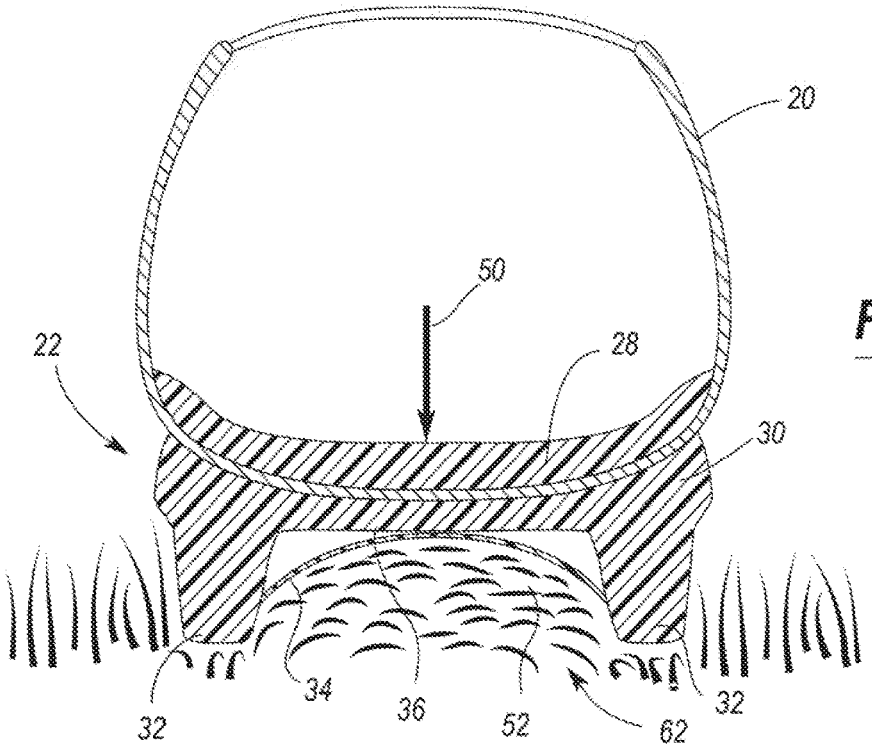
FIG. 3 is a schematic cross-sectional view of an article of footwear, such as shown in FIG. 2, with adhered ground material between a plurality of protrusions.
Figure 4:
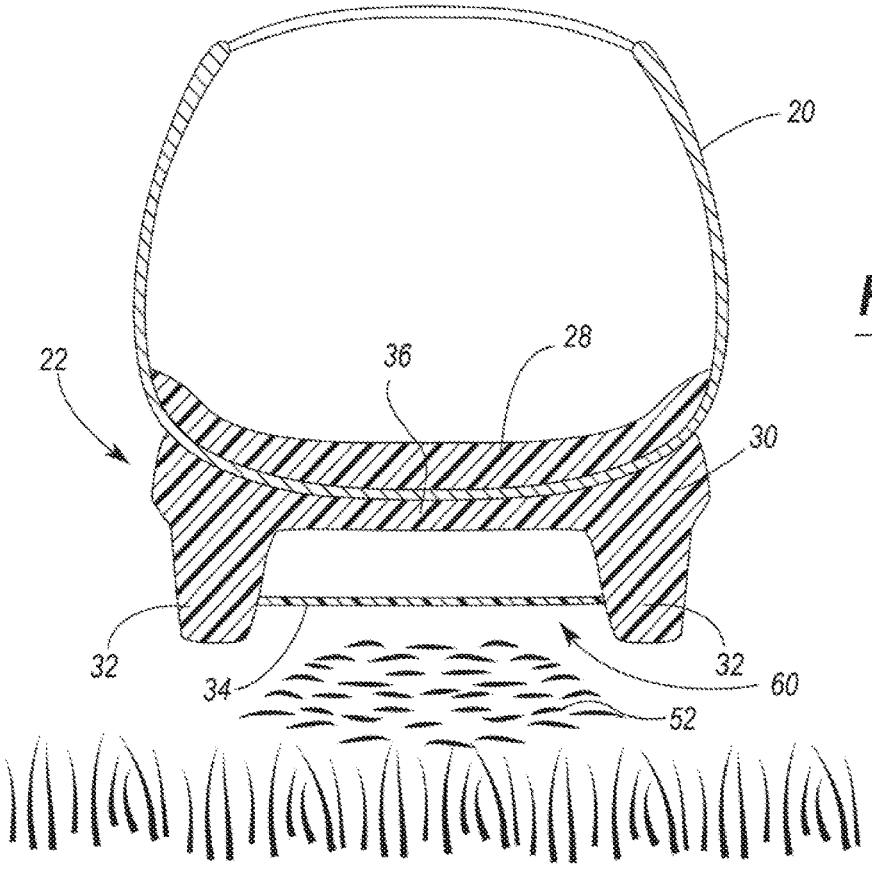
FIG. 4 is a schematic cross-sectional view of the article of footwear of FIG. 3, with the ground material being ejected.

Referring generally to FIGS. 3 and 4, during use of the present article of footwear 10, a portion of the weight of the wearer may apply a force 50 through the upper 20 that causes ground material 52 to at least partially compact between the protrusions 32. As generally illustrated in FIG. 3, in response to the applied force 50 and corresponding reaction force provided by the ground material 52, the membrane layer 34 may elastically deform toward the base layer 36. When the applied force 50 is removed (FIG. 4), such as when the wearer lifts the foot away from the ground, the membrane layer 34 may attempt to return to its undeformed state. In doing so, the elastic, restorative spring force of the membrane layer 34 may urge the compacted ground material 52 away from the base layer 36.

In one configuration, to provide suitable flexibility and elasticity, the membrane layer 34 may be formed from a polymeric material that has a 300% modulus of from about 10 kg/cm$^3$ to about 110 kg/cm$^3$. As used herein, a 300% modulus refers to the tensile stress required to elongate a specimen by 300% according to ASTM standard D412. Likewise, for the same reasons, the polymeric material may have a hardness, measured on the Shore A scale of from about 30 A to about 80 A, measured according to ASTM standard D2240. In other configurations, the material may have a hardness of from about 50 A to about 80 A, or from about 60 A to about 70 A, or even from about 62 A to about 68 A. In one configuration, the polymeric material may be or may include an elastomeric rubber or an elastomeric thermoplastic polyurethane.

The membrane layer 34 may specifically be a thin polymeric sheet that has a thickness of from about 0.1 mm to about 4.0 mm, or alternatively from about 1.0 mm to about 3.0 mm. The specific construction of the membrane layer 34 may include either a single polymeric layer, or may be formed from a plurality of layers that have different physical properties and/or permeabilities. For example, in one configuration, the membrane layer 34 may include alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The membrane layer 34 may also be a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Additional suitable materials for the membrane layer 34 are disclosed in U.S. Pat. Nos. 4,183,156 and 4,219,945 to Rudy which are incorporated by reference in their entireties. Further suitable materials for the membrane layer 34 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties.

In one configuration, the membrane layer 34 may include an outer surface or surface coating that is hydrophobic such that the static contact angle of liquid water on the surface of the membrane is greater than about 130 degrees. In another configuration, the outer surface is hydrophobic such that the static contact angle of liquid water on the surface of the membrane is greater than about 150 degrees. Hydrophobicity may aid in preventing ground material from sticking to the membrane layer 34. In other embodiments, the membrane layer 34 may be hydrophilic, such that the static contact angle of liquid water on the surface of the membrane is less than about 95 degrees, or even less than about 75 degrees. A hydrophilic outer surface may aid in increasing traction on damp or wet surfaces.

Figure 5:
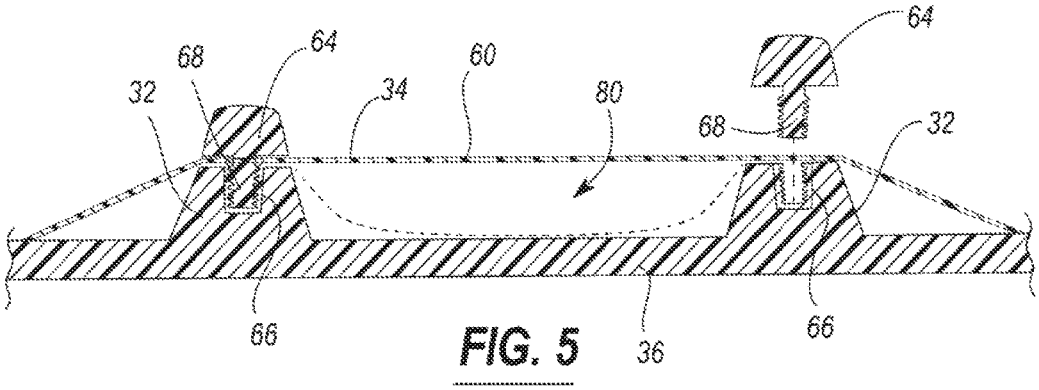
FIG. 5 is a schematic cross-sectional view of an embodiment of a membrane layer secured to an outsole.
Figure 6:
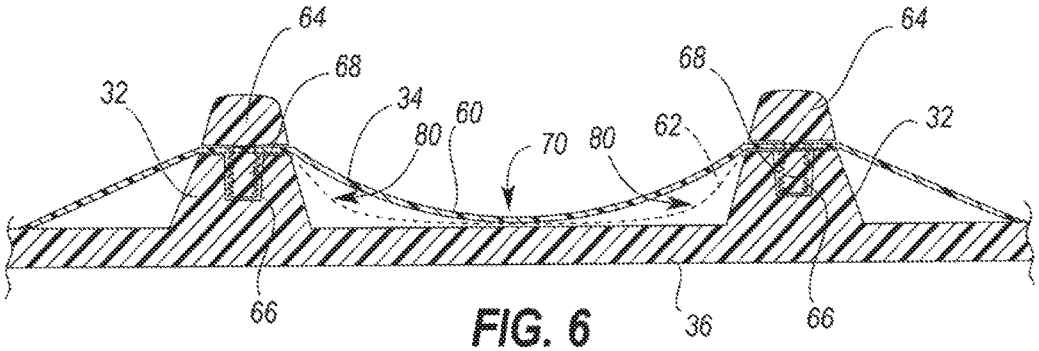
FIG. 6 is a schematic cross-sectional view of an embodiment of a membrane layer secured to an outsole.
Figure 7:
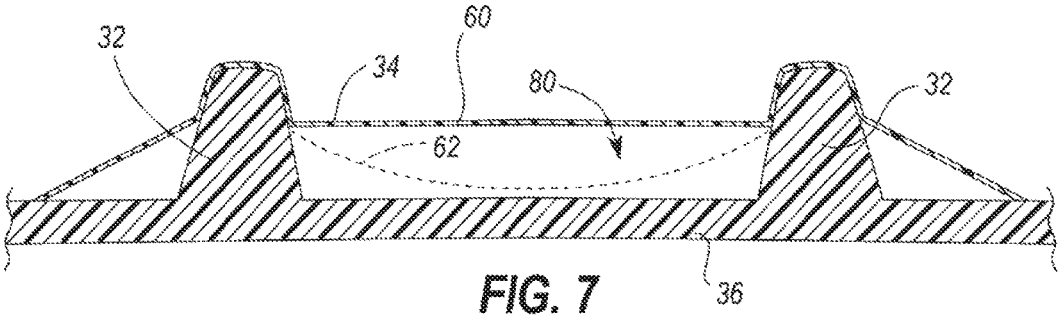
FIG. 7 is a schematic cross-sectional view of an embodiment of a membrane layer secured to an outsole.

FIGS. 5-7 illustrate three ways in which the membrane layer 34 may extend between the plurality of protrusions 32. Each figure represents the membrane layer 34 in a neutral, undeformed state (at 60) and in a deformed state (at 62), with the deformed state illustrated in phantom. In FIGS. 5 and 6, the membrane layer 34 may be mechanically captured between each protrusion 32 and a traction element 64 that is secured into the respective protrusion 32. The traction element 64 may be an extension of the protrusion 32, such as schematically shown, or it may involve a more complex geometry, such as a golf spike. The traction element 64 may be secured into a corresponding anchor 66 provided in the protrusion 32. The anchor 66 may include, for example, a threaded bore that receives and secures a corresponding threaded portion 68 of the traction element 64.

FIG. 7 schematically illustrates a different configuration, where the membrane layer 34 extends over each of the plurality of protrusions 32. In this embodiment, the membrane layer 34 may be adhered to an outer surface of each of the protrusions 32 via an adhesive, such as an epoxy or cement, or through a joining process such as thermal fusion or ultrasonic welding. In this configuration, the membrane layer 34 need not be mechanically captured, such as in the configurations of FIGS. 5 and 6; however, the use of traction elements may still be possible.

Referring again to FIG. 6, in one configuration, a portion of the membrane layer 34 may be bonded to the base layer 36 at an intermediate location 70 between the protrusions 32. In doing so, the membrane layer 34 may only deform at a location between the intermediate location 70 and the protrusion 32. While such a design may limit the overall ability to eject ground material from between the protrusions 32, it may still prevent ground material from lodging in internal corners between the base layer 36 and the protrusions 32. By ejecting the ground material at these peripheral edges, such a design may be equally effective at dislodging any compacted ground material.

Referring again to FIG. 2, the membrane layer 34, base layer 36, and protrusions 32 may cooperate to at least partially define a volume 80. This volume 80 may provide the space for the membrane layer 34 to elastically deform, and is generally filled with a gas. In one configuration, the volume 80 may be vented to the atmosphere to allow the membrane layer 34 to freely deform without having to compress the gas. In other embodiments, however, the volume 80 may be a closed volume where the internal gas must either be compressed or internally redistributed for the membrane layer 34 to deform. In this manner, when the sole structure is lifted away from the ground (i.e., some or all of the applied force is removed), the spring force provided by the captured gas may aid in restoring the membrane layer 34 toward its neutral state, thus urging any captured debris/ground material out from between the protrusions 32.

In an embodiment, the membrane layer 34 may have some degree of transparency such that a design provided on the base layer 36 may be at least partially visible through the membrane layer 34. In this embodiment, the degree of transparency is greater than zero, and may include translucent materials to the extent that at least a color or boundary line of the design is visible through the membrane layer 34. In one configuration, the design may be a corporate logo or similar indicia, however, in other configurations, the design may be a more abstract color or pattern.

The membrane layer 34 may also be textured and/or may have one or more repeating patterns embossed into its surface. For example, in one configuration, the membrane layer 34 may include an embossed, repeating herringbone design. In another configuration, the membrane layer 34 may include a repeating waffle pattern or even a repeating egg crate-like pattern. By including an embossed pattern, the membrane layer 34 may be capable of deforming to a greater degree than would be possible if it were smooth.

In one configuration, a method of manufacturing an article of footwear may begin by providing an outsole including a plurality of protrusions extending from a base layer. A membrane layer may then be affixed to the outsole such that the membrane layer extends between the plurality of protrusions and includes at least a portion that is separated from the base layer by a distance. The membrane layer may be formed to have any or all of the properties identified above, and may be affixed to the outsole such that it cooperates with the outsole to form a volume. In one configuration, the volume may be vented to the atmosphere, however, in other configurations, the volume may be a closed volume that may aid in providing cushioning during impacts.

Affixing the membrane layer 34 to the outsole may involve securing the membrane layer 34 to each of the plurality of protrusions. This may occur, for example, by mechanically capturing the membrane layer 34 between a protrusion 32 and a traction element 64 that is secured to the respective protrusion 32. Alternatively, or in addition to mechanically capturing the membrane layer 34, the affixing may include adhering the membrane layer 34 to the protrusion using an adhesive, such as an epoxy or cement, or through a joining process, such as welding or thermofusing.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items. As used in the claims, "any of" is intended to mean any combination of one or more of the recited claims, including any one of the recited claims.

The invention claimed is:

1. A sole structure for an article of footwear, the sole structure comprising:

an outsole including a plurality of protrusions extending from a base layer; and a membrane layer suspended between the plurality of protrusions and bonded to the base layer at an intermediate location between the plurality of protrusions, the membrane layer including at least a portion that is separated from the base layer by a distance, wherein the membrane layer forms an outer surface of the article of footwear; and wherein the membrane layer is configured to elastically deform toward the base layer in response to an applied force.

2. The sole structure of claim 1, wherein the membrane layer has a thickness of from about 0.1 mm to about 4.0 mm; and wherein the membrane layer is formed from a polymer having a 300% modulus of from about 10 kg/cm$^2$ to about 110 kg/cm$^2$, the 300% modulus referring to the tensile stress required to elongate a specimen by 300% according to ASTM standard D2240.

3. The sole structure of claim 2, wherein the polymer includes at least one of a rubber or a thermoplastic polyurethane.

4. The sole structure of claim 1, wherein the membrane layer has a hardness of from about 30 A to about 80 A, measured on the Shore A scale.

5. The sole structure of claim 1, wherein the membrane layer and the outsole at least partially define a volume.

6. The sole structure of claim 5, wherein the volume is a closed volume; and wherein the closed volume includes a gas.

7. The sole structure of claim 1, wherein the membrane layer is secured to each of the plurality of protrusions.

8. The sole structure of claim 1, wherein the membrane layer is configured to transition from a deformed state toward a neutral state when the applied force is removed; and wherein the transitioning from the deformed state toward the neutral state is operative to eject debris from between the plurality of protrusions.

9. The sole structure of claim 1, wherein each of the plurality of protrusions includes an anchor configured to receive a traction element.

10. The sole structure of claim 9, further comprising a plurality of traction elements, each traction element disposed in the anchor of a respective one of the plurality of protrusions; and wherein the membrane layer is mechanically secured between each of the plurality of protrusions and each of the respective traction elements.

11. The sole structure of claim 1, wherein the membrane layer is hydrophobic such that the static contact angle of liquid water on the surface of the membrane is greater than about 130°.

12. The sole structure of claim 1, wherein the membrane layer is hydrophilic such that the static contact angle of liquid water on the surface of the membrane is less than about 95°.

13. The sole structure of claim 1, wherein the base layer is at least partially visible through the membrane layer.

14. A method of manufacturing a sole structure for an article of footwear, the method comprising:

providing an outsole including a plurality of protrusions extending from a base layer; and affixing a membrane layer to the outsole such that the membrane layer is suspended between the plurality of protrusions and bonded to the base layer at an intermediate location between the plurality of protrusions, wherein the membrane layer includes at least a portion that is separated from the base layer by a distance, wherein the membrane layer forms an outer surface of the article of footwear; and wherein the membrane layer is configured to elastically deform toward the base layer in response to an applied force.

15. The method of claim 14, further comprising forming the membrane layer from a polymer having a 300% modulus of from about 10 kg/cm$^2$ to about 110 kg/cm$^2$, the 300% modulus referring to the tensile stress required to elongate a specimen by 300% according to ASTM standard D2240, and wherein the formed membrane layer has a thickness of from about 0.1 mm to about 4.0 mm.

16. The method of claim 14, wherein affixing the membrane layer to the outsole includes at least partially forming a closed volume between the membrane layer and the outsole.

17. The method of claim 14, wherein affixing the membrane layer to the outsole includes securing the membrane layer to each of the plurality of protrusions.

18. The method of claim 14, further comprising securing a traction element to a protrusion of the plurality of protrusions, and wherein affixing the membrane layer to the outsole includes mechanically securing the membrane layer between the traction element and the protrusion.

* * * * *